US009209560B2

(12) United States Patent
Wei

(10) Patent No.: US 9,209,560 B2
(45) Date of Patent: Dec. 8, 2015

(54) ELECTRONIC BLOCK WITH MAGNETIC CONNECTION

(71) Applicant: Zhengpeng Wei, Guangdong (CN)

(72) Inventor: Zhengpeng Wei, Guangdong (CN)

( * ) Notice: Subject to any disclaimer, the term of this patent is extended or adjusted under 35 U.S.C. 154(b) by 33 days.

(21) Appl. No.: 14/298,965

(22) Filed: Jun. 9, 2014

(65) Prior Publication Data

US 2015/0325949 A1 Nov. 12, 2015

(30) Foreign Application Priority Data

May 12, 2014 (CN) ..... 2014 1 0197233

(51) Int. Cl.

| | |
|---|---|
| ***H01R 11/30*** | (2006.01) |
| ***H01R 13/62*** | (2006.01) |
| ***H01F 7/02*** | (2006.01) |
| ***H01R 13/46*** | (2006.01) |

(52) U.S. Cl.

CPC ..... *H01R 13/6205* (2013.01); *H01F 7/0263* (2013.01); *H01R 13/46* (2013.01)

(58) Field of Classification Search

CPC .... H01R 13/6205; H01R 13/46; H01R 13/62; H01B 12/00; H01F 7/0263

USPC ..... 439/39

See application file for complete search history.

(56) References Cited

U.S. PATENT DOCUMENTS

| | | | | |
|---|---|---|---|---|
| 7,311,526 | B2 * | 12/2007 | Rohrbach | H01R 13/6205 439/218 |
| 2005/0030338 | A1 * | 2/2005 | Silverbrook | B41J 2/14 347/47 |
| 2006/0289820 | A1 * | 12/2006 | Chen | F16K 31/047 251/129.11 |
| 2014/0113461 | A1 * | 4/2014 | Kim | H01R 13/6205 439/39 |
| 2014/0162468 | A1 * | 6/2014 | Kim | H01R 13/6205 439/39 |
| 2015/0111398 | A1 * | 4/2015 | Isenhour | H01R 13/6205 439/39 |

* cited by examiner

*Primary Examiner* — Jean F Duverne

(57) ABSTRACT

The present invention discloses an electronic block with magnetic connection, wherein end portions of the block are provided with cavities, the cavities are embedded with radially magnetized conductive circular magnets, and the circular magnets can freely rotate about their own axes within the cavities to adjust magnetic poles; the surfaces via which each end portion is attached to other end portions are cut with notches, and the circular magnets partially protrude from the notches; the end portion of one block can be attached to and electrically connected with the end portion of any other block via the circular magnets. By adopting radially magnetized and self-rotating magnets, the present invention can realize attachment and electrical connection of any multiple surfaces and multiple angles, not only ensuring close connection between blocks, but also realizing electrical connection of components in the blocks.

6 Claims, 6 Drawing Sheets

ELECTRONIC BLOCK WITH MAGNETIC CONNECTION

BACKGROUND OF THE INVENTION

The present invention relates to an electronic splicing-type toy, in particular, relates to an electronic block comprising multiple electronic components, such that a complete loop having a designated function can be organized between blocks via magnetic connection.

Electronic block learning is intuitive and interesting; spliced electronic devices can be applied in real life; electronic blocks convert complicated knowledge on electronic and circuit into simple forms of blocks with visualizing means, such that children can experience joy of myriads of changes in the electronic world, and children at different age stages can acquire the contents with different difficulties.

At present, the electronic blocks on the market and in the prior art, are to secure electronic components such as wire, bulb, diode, triode, resistance, capacitance, various switches, ammeter, motor, loudspeaker, integrated module, on plastic sheets (blocks), to use unique snap fasteners to make individual accessories that can be spliced, and to splice and install circuit combinations just like splicing blocks on the installation bottom plate provided with the products.

At present, the electronic blocks on the market and in the prior art, are to secure electronic components such as wire, bulb, diode, triode, resistance, capacitance, various switches, ammeter, motor, loudspeaker, integrated module, on plastic sheets (splicing blocks), to use unique snap fasteners to make individual accessories that can be spliced, and to splice and install circuit combinations just like splicing blocks on the installation bottom plate provided with the products. The invention patent (patent No. CN2245796Y) of versatile electronic block discloses all technologies of this traditional electronic block; such electronic block must adopt an installation base, and various component modules are connected with each other and communicate with circuits by taking metal snap fasteners as connectors and conductive contacts. The traditional electronic block suffers from the following defects: 1. during actual use, plug and pull with great force is needed, even a installation base needs to be provided, so the manner of splicing and arranging is not convenient enough; 2. snap fasteners, as conductive contacts, lead to great loss in electrical energy, and are also easily damaged; 3. the connection manner is single, i.e., only the single connection of snap fasteners, thereby limiting diversity and interest in stacking up electronic blocks; 4. a majority of electronic components are directly exposed outside the splicing blocks; when children play blocks, not only these electronic components are easily damaged, but also the potential risk of mistaken eating may occur, so the safety of the product needs to be further improved; 5. the blocks cannot be attached onto the magnetic boards and plates (e.g., white board), so the practicability needs to be further expanded.

On the current markets, there also is a multi-surface magnetic block, adopting radially magnetized magnets to realize attachment at multiple orientations, in which block the magnets are enwrapped by metal splicing structures, and the metal splicing structures are electrically connected with electronic components. Although the conductivity of metal sheet copper is better than that of the magnets, since the number of the constituting modules is relatively large, the production costs are relatively high. Moreover, since the metal splicing structures are arranged in an exposed way, and are easily subjected to atmospheric oxidation, long-term use may lead to oxidation, thereby causing failures such as bad contact. Meanwhile, because the magnets are enwrapped by the metal splicing structures, when two blocks are attached with each other, the requirement for the magnetic field strength of the magnets is also much higher, and magnets with magnetic fields are needed.

BRIEF SUMMARY OF THE INVENTION

To solve the above problems, the present invention intends to provide an electronic block capable of being connected at multiple orientations, in which block magnetic modules directly complete magnetic attachment and electrical connection, for the purpose of improving the effects of attachment and electric conduction while further simplifying the structure for the block.

In order to realize the technical objective, the solution of the present invention is as follows: an electronic block with magnetic connection, the block being embedded with an electronic component, wherein the block comprises at least two protuberant conductive end portions; each end portion is provided with a cavity, the cavity is embedded with a radially magnetized conductive circular magnet, and the circular magnet can freely rotate about its own axis within the cavity to adjust magnetic poles; surfaces via which each end portion is attached to other end portions are each cut with a notch, and the circular magnet partially protrudes from the notch; an end portion of one block can be attached to and electrically connected with an end portion of any other block via the circular magnet; each end portion is provided with an elastic connector of a non-magnetic material, one end of the elastic connector closely contacts the circular magnet at the end portion, and another end of the elastic connector is electrically connected with the electronic component.

As a preferred embodiment, the block can be a cuboid with two end portions, and can also be a mold with multiple end portions.

As a preferred embodiment, the elastic connector is a tension spring or an elastic sheet.

As a preferred embodiment, the surfaces via which each end portion is attached to other end portions are a front end surface and two side surfaces, and each surface is cut with a notch partially exposing a circular magnet.

As a preferred embodiment, the block consists of an upper housing body and a bottom housing body, the circularly magnet is a circular ring magnet, the site of the bottom housing body located in the cavity is equipped with a central column, and the circular ring magnet encases the central column to freely rotate about the central column.

As a preferred embodiment, the electronic element can be any one of battery, light emitting module, switch module, slide rheostat module, and vocal module.

The advantageous effects of the present invention are as follows: adopting radially magnetized and self-rotating magnets, can realize attachment and electrical connection of any multiple surfaces and multiple angles, not only ensuring close connection between blocks, but also realizing electrical connection of components in the blocks, thereby constituting a complete loop; the parts which need to be connected in the solution are simple and few, such that the production costs can be greatly reduced; since the magnets per se have a very good conductivity, resistance can be reduced, and stability of electrical connection can be improved; since the magnets are adopted for direct connection, magnetic attachment force is much stronger, the connection among blocks is much closer, the requirement for the magnetic field strength of the magnets is much looser.

DETAILED DESCRIPTION OF THE INVENTION

The present invention is further described below in details by combing the drawings and specific embodiments.

Figure 1:
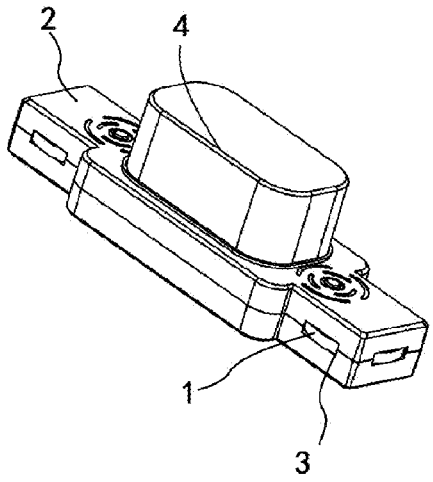
FIG. 1 is a schematic diagram of the structure for Embodiment One of the present invention.
Figure 2:
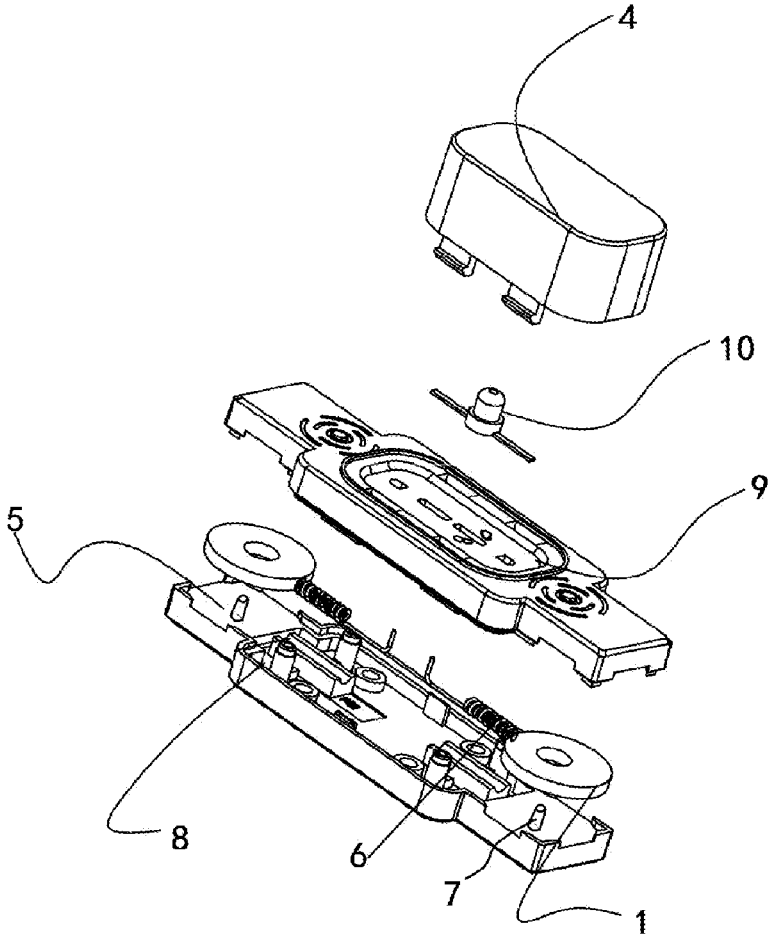
FIG. 2 is an exploded view of Embodiment One of the present invention.
Figure 3:
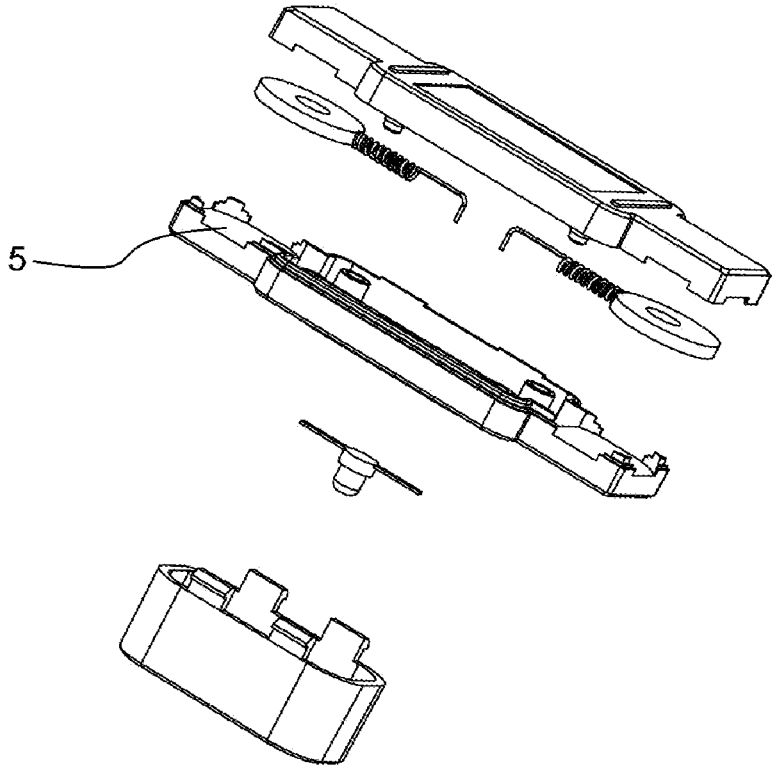
FIG. 3 is a top exploded view of Embodiment One of the present invention.

As shown in FIGS. 1, 2 and 3, Embodiment One of the present invention is an electronic block with magnetic connection (a light emitting component with LED lights), wherein the block is provided with an electronic component 10, the comprises at least two protuberant conductive end portions 2; each end portion is provided with a cavity 5, the cavity 5 is embedded with a radially magnetized conductive circular magnet 1, and the circular magnet 1 can freely rotate about its own axis within the cavity to adjust magnetic poles; surfaces via which each end portion 2 is attached to other end portions are each cut with a notch 3, and the circular magnet 1 partially protrudes from the notch 3; an end portion of one block can be attached to and electrically connected with an end portion of any other block via the circular magnet (i.e., the circular magnet is directly a conductive terminal, and electric conduction is realized after its magnetic contact with other blocks directly via the magnets); each end portion is provided with an elastic connector 6 of a non-magnetic material, one end of the elastic connector 6 closely contacts the circular magnet 1 at the end portion, and another end of the elastic connector is electrically connected with the electronic component 10. When the end portion of one block is spliced with the end portion of another block, the magnets not only provide magnetic connection but also act as a conductive line; the magnets contact with each other directly, thereby leading to a much stronger magnetism, such that two adjacent blocks can be attached together closely; moreover, three side surfaces of each end portion can be connected with the end portions of other blocks, thereby realizing multiple circuit loops; since the magnets have radially magnetized circular structures, the magnets can automatically adjust directions so as to be attached with the magnets in the corresponding adjacent blocks. Hence, the end portion structure of the present solution can break through the traditional splicing manner at a fixed direction, with freer splicing manner, and with more joys.

The elastic connector 6 is a tension spring or an elastic sheet, and even if the circular magnet rotates such that displacement is caused, the magnet can also be electrically connected with the elastic connector closely. It should be noted that, the elasticity of the elastic connector cannot be too strong such that the circular magnet gets stuck and is unable to freely rotate to adjust magnetic poles, which is the common knowledge of persons skilled in the art when handling this detail, i.e., the elasticity of the elastic connector only needs to meet the efficacy of close contact with the circular magnet.

The surfaces via which each end portion 2 is attached to other end portions are a front end surface and two side surfaces, and each surface is cut with a notch 3 partially exposing a circular magnet. In the best embodiment, the block consists of an upper housing body 9 and a bottom housing body 8, the circularly magnet 1 is a circular ring magnet, the site of the bottom housing body 8 located in the cavity 5 is equipped with a central column 7, and the circular ring magnet encases the central column 7 to freely rotate about the central column, such that it can be ensured that the magnet does not incur a too large displacement to deviate from the connection range of the elastic connector; this is only a specific best embodiment, and other magnet structures can also realize the technical objective of the present invention.

The electronic element can be any one of battery, light emitting module, switch module, slide rheostat module, and vocal module; certainly, can also be resistance, inductance, capacitance, motor, switch, etc., all of which need to be prepared according to specific functional needs of blocks. In the best embodiment, the top end of the electronic component is usually covered by a protection cover 4, via which protection cover the electronic component can be protected from damages.

Figure 4:
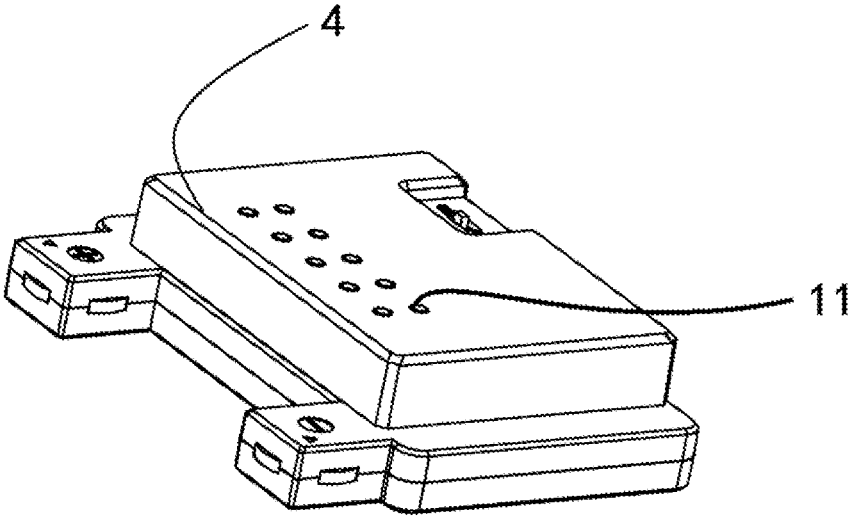
FIG. 4 is a schematic diagram of the structure for Embodiment Two of the present invention.
Figure 5:
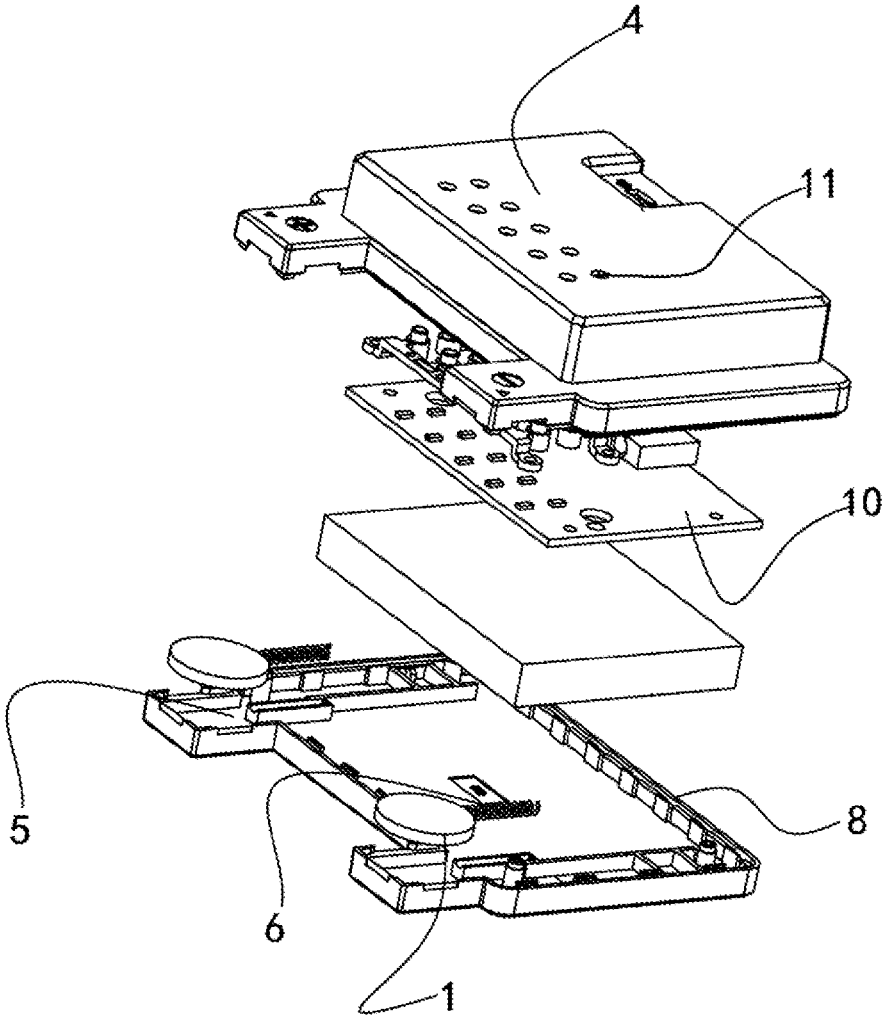
FIG. 5 is an exploded view of Embodiment Two of the present invention.

During applications, the block can be a cuboid with two end portions, and can also be a mold with multiple end portions, which is shown in FIGS. 8 and 9, and FIGS. 4 and 5. In fact, the positions of the end portions are designed according to uses of blocks, e.g., the battery module 4 as shown in FIGS. 4 and 5, is designed to be at the same side, and acts as the output terminal of anode and cathode of the battery; the block with the battery module is further equipped with a light unit 11 and a circuit board 10, adapted for use.

Figure 6:
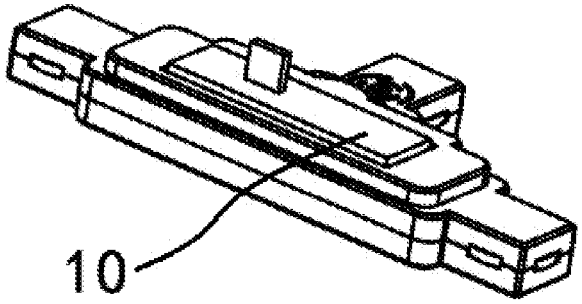
FIG. 6 is a schematic diagram of the structure for Embodiment Three of the present invention.
Figure 7:
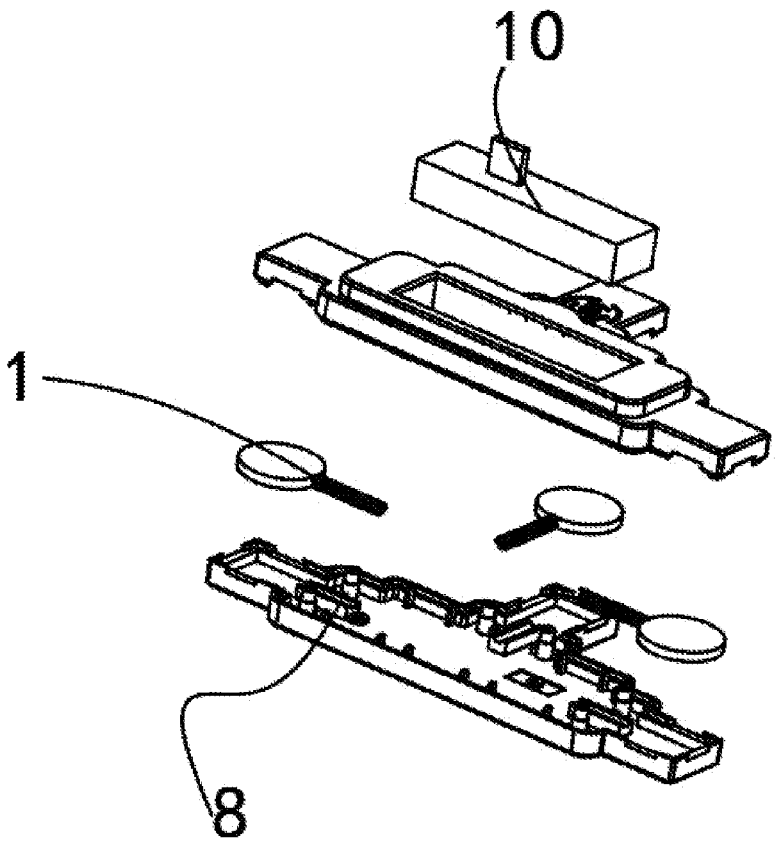
FIG. 7 is an exploded view of Embodiment Three of the present invention.

The block as shown in FIGS. 6 and 7, is a block having a slide rheostat module 10, which module can adjust the magnitude of resistance.

Figure 8:
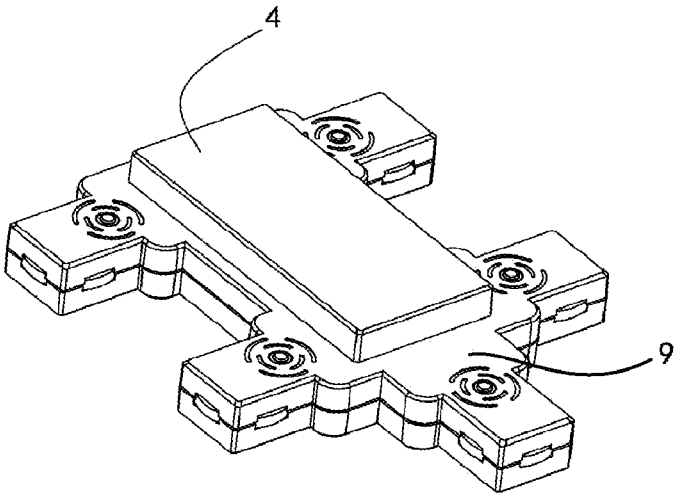
FIG. 8 is a schematic diagram of the structure for Embodiment Four of the present invention.
Figure 9:
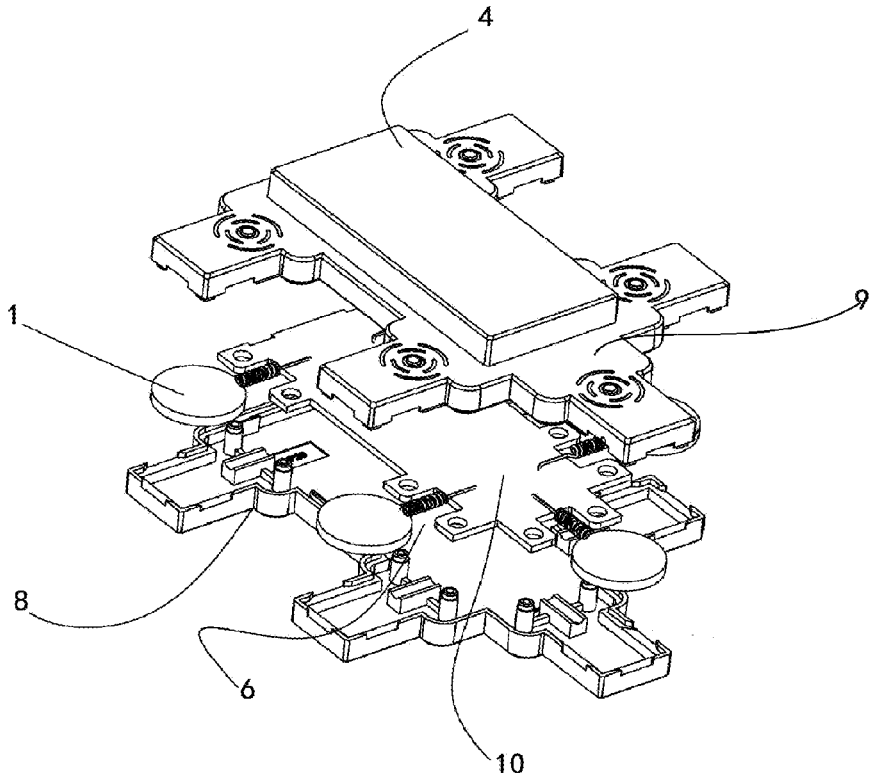
FIG. 9 is an exploded view of Embodiment Four of the present invention.

The block as shown in FIGS. 8 and 9, is a block having a music module, and the electronic component in the figures is an integrated circuit module 10 of the music module.

The present invention adopts direct connection by magnets to realize electrical connection of components in the blocks; the parts which need to be connected in the solution are simple and few, such that the production costs can be greatly reduced; since the magnets per se have a very good conductivity, resistance can be reduced, and stability of electrical connection can be improved; since the magnets are adopted for direct connection, magnetic attachment force is much stronger, the connection among blocks is much closer. Meanwhile, since circular magnets are adopted, and the magnets can self rotate, it can be ensured that normal magnetic attachment and connection can be realized at any direction.

Figure 10:
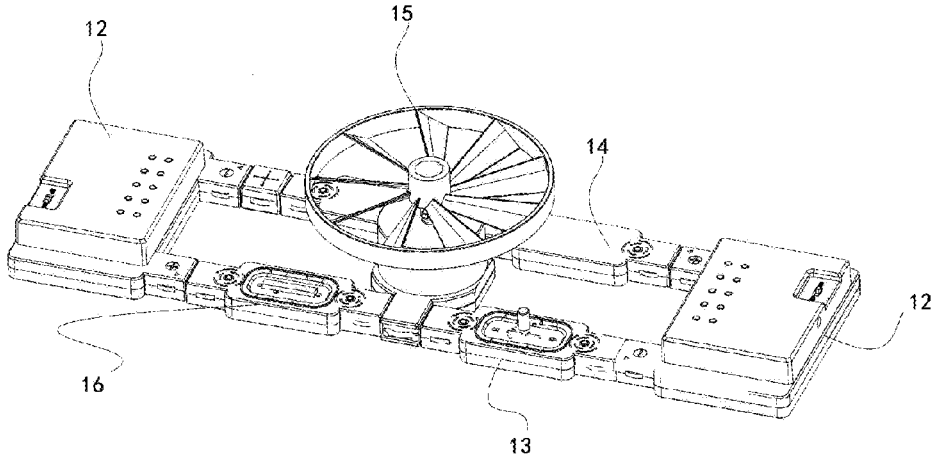
FIG. 10 is a schematic diagram of use when the blocks in different embodiments of the present invention are spliced together.

The present invention can embed electronic components in daily life into the blocks, or integrate some function into the blocks. For example, as shown in FIG. 10, when a fan 15 which can be adjusted for rotating clockwise or anticlockwise is to be spliced, the splicing uses blocks of battery module 12 at the left side and the right side respectively which blocks are connected via a block of wire module 14, connects a block of switch module 13 in series, and connects a block of tongue tube 16 in series at another end; as regards the splicing as shown in FIG. 10, when the switch 13 is opened, the fan rotates clockwise, and when the switch 13 is closed, conduction is realized using the tongue tube of magnetic induction, and the fan rotates anticlockwise. The above playing manner is characterized by endless joy, in particular, teaching in joy, and has great benefit in children's study and interest in circuit knowledge.

Figure 11:
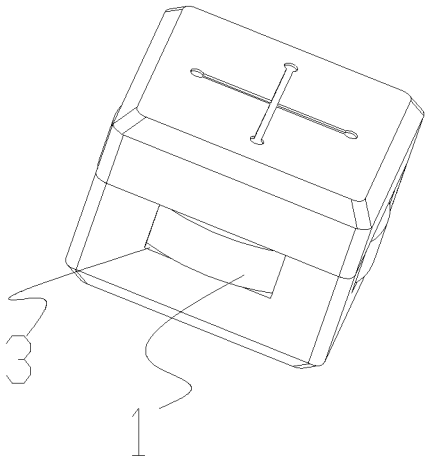
FIG. 11 is a schematic diagram of the stereoscopic structure for the connecting square block of the present invention.
Figure 12:
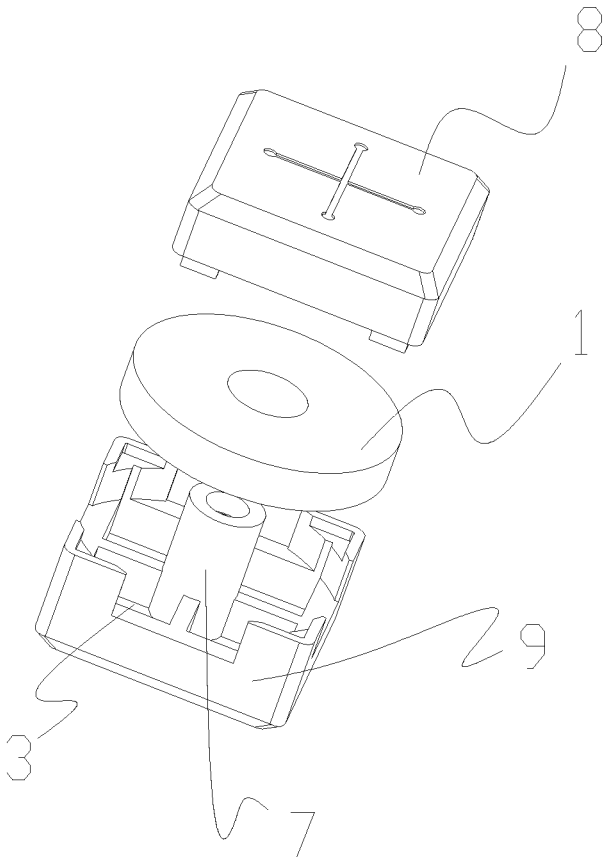
FIG. 12 is an exploded view of the connecting square block of the present invention.

In order to enable connection among blocks to be more interesting and much easier, according to principles, the present invention further designs a connecting square block dedicated for connection. As shown in FIGS. 11 and 12, the connecting square block consists of an upper housing body 9, a bottom housing body 8 and a circular magnet 1, the circular magnet 1 is a circular ring magnet, the upper housing body and the bottom housing body encapsulate a cavity 5, a central column 7 is provided in the middle of the cavity 5, the circular ring magnet is encases the central column 7 to freely rotate about it, four side surfaces of the square block encapsulated by the upper and bottom housing bodies are each provided with a notch 3, and the circular magnet 1 partially protrudes from the notch 3; the end portion of the connecting square block can be attached to and electrically connected with the end portion of any other block via the circular magnet 1 (i.e., the circular magnet is directly a conductive terminal, and electric conduction is realized after its magnetic contact with other blocks directly via the magnets). The above connecting square block is not provided with any electronic component.

All the contents as stated above, are only better embodiments of the present invention, and are not used to limit the present invention; any subtle amendment, equivalent replacement and improvement that is made to the above embodiments according to the technical substance of the present invention, shall fall within the protection scope of the technical solution of the present invention.

What is claimed is:

1. An electronic block with magnetic connection, the block being embedded with an electronic component, characterized in that:

the block comprises at least two protuberant conductive end portions;

each end portion is provided with a cavity, the cavity is embedded with a radially magnetized conductive circular magnet, and the circular magnet can freely rotate about its own axis within the cavity to adjust magnetic poles;

surfaces via which each end portion is attached to other end portions are each cut with a notch, and the circular magnet partially protrudes from the notch; an end portion of one block can be attached to and electrically connected with an end portion of any other block via the circular magnet;

each end portion is provided with an elastic connector of a non-magnetic material, one end of the elastic connector closely contacts the circular magnet at the end portion, and another end of the elastic connector is electrically connected with the electronic component.

2. The electronic block with magnetic connection according to claim 1, characterized in that: the block can be a cuboid with two end portions, and can also be a mold with multiple end portions.

3. The electronic block with magnetic connection according to claim 2, characterized in that: the elastic connector is a tension spring or an elastic sheet.

4. The electronic block with magnetic connection according to claim 3, characterized in that: the surfaces via which each end portion is attached to other end portions are a front end surface and two side surfaces, and each surface is cut with a notch partially exposing a circular magnet.

5. The electronic block with magnetic connection according to claim 4, characterized in that: the block consists of an upper housing body and a bottom housing body, the circular magnet is a circular ring magnet, the site of the bottom housing body located in the cavity is equipped with a central column, and the circular ring magnet encases the central column to freely rotate about the central column.

6. The electronic block with magnetic connection according to any one of claims 1 to 5, characterized in that: the electronic element can be any one of battery, light emitting module, switch module, slide rheostat module, and vocal module.

* * * * *